US008787599B2

(12) United States Patent
Grattan

(10) Patent No.: US 8,787,599 B2
(45) Date of Patent: Jul. 22, 2014

(54) REDUCED MICROPHONE HANDLING NOISE

(75) Inventor: Alan Grattan, Santa Cruz, CA (US)

(73) Assignee: Plantronics, Inc., Santa Cruz, CA (US)

( * ) Notice: Subject to any disclaimer, the term of this patent is extended or adjusted under 35 U.S.C. 154(b) by 817 days.

(21) Appl. No.: 12/886,417

(22) Filed: Sep. 20, 2010

(65) Prior Publication Data

US 2012/0070018 A1 Mar. 22, 2012

(51) Int. Cl.
*H04R 3/00* (2006.01)

(52) U.S. Cl.
USPC ..... 381/122; 381/58; 381/94.1

(58) Field of Classification Search
USPC ..... 381/91–92, 94.1–94.3, 94.7, 122, 26, 381/56, 111, 355, 375, 113, 58
See application file for complete search history.

(56) References Cited

U.S. PATENT DOCUMENTS

| | | | | |
|---|---|---|---|---|
| 8,477,955 | B2 * | 7/2013 | Engle et al. | 381/71.1 |
| 8,634,565 | B2 * | 1/2014 | Asada et al. | 381/56 |
| 2004/0252857 | A1 * | 12/2004 | Lewis | 381/355 |
| 2007/0079206 | A1 * | 4/2007 | Arora et al. | 714/745 |
| 2008/0159568 | A1 * | 7/2008 | Asada et al. | 381/150 |
| 2011/0228950 | A1 * | 9/2011 | Abrahamsson et al. | 381/94.1 |

* cited by examiner

*Primary Examiner* — Disler Paul
(74) *Attorney, Agent, or Firm* — Chuang Intellectual Property Law

(57) ABSTRACT

Methods and apparatuses for reduced microphone handling noise are disclosed. In one example, a microphone system includes a microphone to output a microphone output signal and a sensor adapted to output a sensor signal indicating whether the sensor is in proximity to or touching a user finger. A processor is adapted to process the microphone output signal using touch mode signal processing responsive to a determination the sensor is in proximity to or touching the user finger.

21 Claims, 5 Drawing Sheets

REDUCED MICROPHONE HANDLING NOISE

BACKGROUND OF THE INVENTION

When a microphone user handles a microphone, either at a microphone clip or elsewhere on the microphone, an undesirable signal is produced which is detected by the microphone. Often, the detected signal is higher than the intended audio signal, and results in noise transmitted to a listener. In the prior art, microphone designs have used suspension systems or large masses attached to the microphone element to reduce this type of handling noise. However, these solutions undesirably increase the size of the overall design significantly or offer limited noise reduction.

As a result, improved methods and apparatuses for microphones with reduced handling noise are needed.

BRIEF DESCRIPTION OF THE DRAWINGS

The present invention will be readily understood by the following detailed description in conjunction with the accompanying drawings, wherein like reference numerals designate like structural elements.

DESCRIPTION OF SPECIFIC EMBODIMENTS

Figure 1:
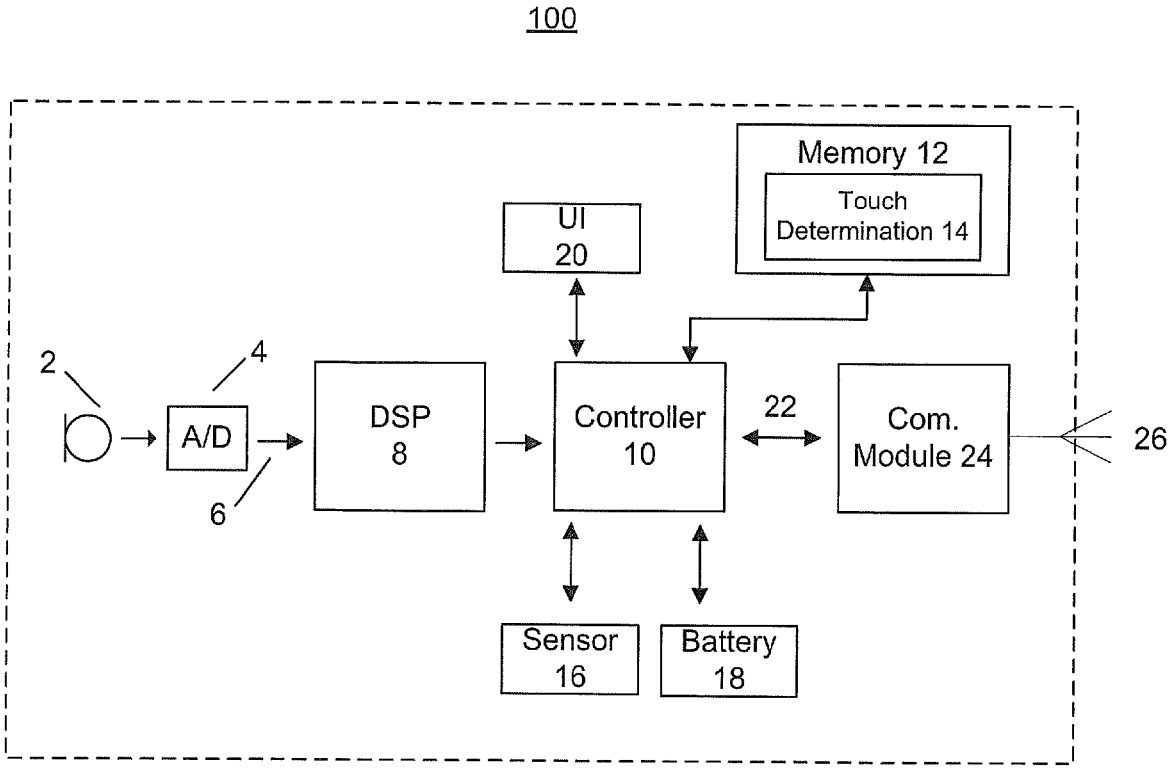
FIG. 1 illustrates a simplified block diagram of the components of a microphone system in one example of the invention.

Methods and apparatuses for microphones are disclosed. The following description is presented to enable any person skilled in the art to make and use the invention. Descriptions of specific embodiments and applications are provided only as examples and various modifications will be readily apparent to those skilled in the art. The general principles defined herein may be applied to other embodiments and applications without departing from the spirit and scope of the invention. Thus, the present invention is to be accorded the widest scope encompassing numerous alternatives, modifications and equivalents consistent with the principles and features disclosed herein. For purpose of clarity, details relating to technical material that is known in the technical fields related to the invention have not been described in detail so as not to unnecessarily obscure the present invention.

This invention relates to noise reduction solutions in microphones. In one example, a microphone incorporates sensors which detect that the user is touching or about to touch the microphone. Once the sensor detects the touch or impending touch, the microphone system conditions the transmit signal to avoid sending a loud or other undesirable signal to the receiver. The enhanced conditioning may include simple attenuation, temporary use of a audio compressor/limiter, or other ways to smooth out the signal. After the sensors detect the microphone is no longer being touched (i.e., handled) the microphone returns to the optimum/normal mode of processing the transmit signal.

In this manner, the un-unintended handling noise in the microphone signal is reduced before it is sent to the receiving side. For example, a more controlled signal level is produced by reducing the peak un-intended signal from causing system distortion and/or destabilizing AGC systems.

In one example, a microphone system includes a microphone element to output a microphone output signal and a touch sensor disposed on or within proximity of an outward facing surface of a microphone system housing. The system includes a touch sensor circuit coupled to the touch sensor configured to receive signals from the touch sensor and determine whether the touch sensor is touching a user skin surface. The system further includes a processor adapted to process the microphone output signal using a modified signal processing responsive to a determination the touch sensor is touching a user skin.

In one example, a method for processing a microphone signal includes receiving a microphone signal output from a microphone element, and receiving a sensor output signal indicating a first condition where a user skin is not in proximity to or in contact with the sensor or indicating a second condition where the user skin is in proximity to or in contact with the sensor. The microphone signal is processed responsive to the sensor output signal.

In one example, a microphone system includes a microphone to output a microphone output signal, a sensor adapted to output a sensor signal indicating whether the sensor is in proximity to or touching a user finger, and a processor adapted to process the microphone output signal using touch mode signal processing responsive to a determination the sensor is in proximity to or touching the user finger.

In one example, a method for processing a microphone signal includes receiving a microphone signal output from a microphone element and processing the microphone signal using a first signal processing method. A sensor output signal is received indicating a user finger in proximity to or in contact with a sensor. The microphone signal is processed using a second signal processing method responsive to receiving the sensor output signal indicating the user finger in proximity to or in contact with the sensor. An updated sensor output signal is received indicating removal of the user finger from contact with the sensor, and processing the microphone signal using the first signal processing method is resumed.

FIG. 1 illustrates a simplified block diagram of the components of a microphone system in one example of the invention. Microphone system 100 includes a controller 10 that comprises a processor, memory and software. The controller 10 receives input from user interface 20 and manages audio data received from microphone 2. In one example, microphone 2 is an electret condenser microphone. The controller 10 further interacts with wireless communication module 24 to transmit and receive signals from the microphone system 100. In a further example, microphone system 100 is a wired microphone not having a wireless communication module 24. The microphone system 100 includes a touch sensor 16 disposed on or within proximity of an outward facing surface of a microphone system housing. For example, the touch sensor 16 may be a capacitive sensor, infrared detector, pyroelectric sensor, a micro-switch, an inductive proximity switch, or a skin conductivity sensor. In one example, the microphone system housing comprises a clip portion on which the touch sensor 16 is placed. In a further example, the touch sensor 16 may be placed on a user interface 20 button of the microphone system 100. Alternatively, touch sensor 16 may be placed on any other location of the microphone system housing likely to be handled by the user. A memory 12 stores the touch determination firmware 14.

Wireless communication module 24 includes an antenna system 26. The microphone system 100 further includes a power source such as a rechargeable battery 18 which provides power to the various components of the microphone system 100. Wireless communication module 24 may use a variety of wireless communication technologies. The user interface 20 may include a multifunction power, volume, mute, and select button or buttons. Other user interfaces may be included on the microphone system 100.

The microphone system 100 includes a microphone 2 for receiving an acoustic signal. Microphone 2 is coupled to an analog to digital (A/D) converter 4 which outputs a digitized microphone output signal 6. Digitized microphone output signal 6 is provided to a digital signal processor (DSP) 8 for processing as described herein. A processed signal is ultimately output for transmission via wireless communication module 24.

Memory 12 stores touch determination firmware 14 which processes data from touch sensor 16 to identify whether microphone system 100 is being touched by a user. Memory 12 may also store signals, signal history, or data from touch sensor 16. In one example operation, the controller 10 executing touch determination firmware 14 utilizes data output from a touch sensor circuit coupled to the touch sensor 16, where the touch sensor circuit is configured to receive signals from the touch sensor 16 and determine whether the touch sensor 16 is touching a user skin surface.

Digital signal processor 8 is adapted to process the microphone output signal using a modified signal processing responsive to a determination the touch sensor is touching a user skin. In one example, the modified signal processing responsive to a determination the touch sensor is in proximity to or touching a user skin comprises applying a signal attenuator, compressor, or limiter to attenuate, compress, or limit the microphone output signal. In this manner, undesirable noise and signal artifacts resulting from microphone handling are reduced. In an example further operation, the touch determination firmware 14 is further configured to determine whether the touch sensor 16 is in proximity to the user skin surface, and the processor 8 is further adapted to process the microphone output signal 6 using the modified signal processing responsive to a determination the touch sensor 16 is in proximity to the user skin In a further example, microphone system 100 includes an accelerometer. Responsive to the accelerometer output signal, the digital signal processor 8 processes the microphone output signal using a modified signal processing relative to the normal operation mode. For example, if the accelerometer output signal is a large signal over a short period of time, this indicates that the microphone system 100 has been dropped, whereby the digital signal processor 8 responsively limits the amplitude of the transmit signal or turns off transmission of the transmit signal for a period of time expecting more handling noise. Following a settling time, after which the accelerometer output signal indicates a normal operation mode, the full transmit signal is re-enabled.

Figure 2:
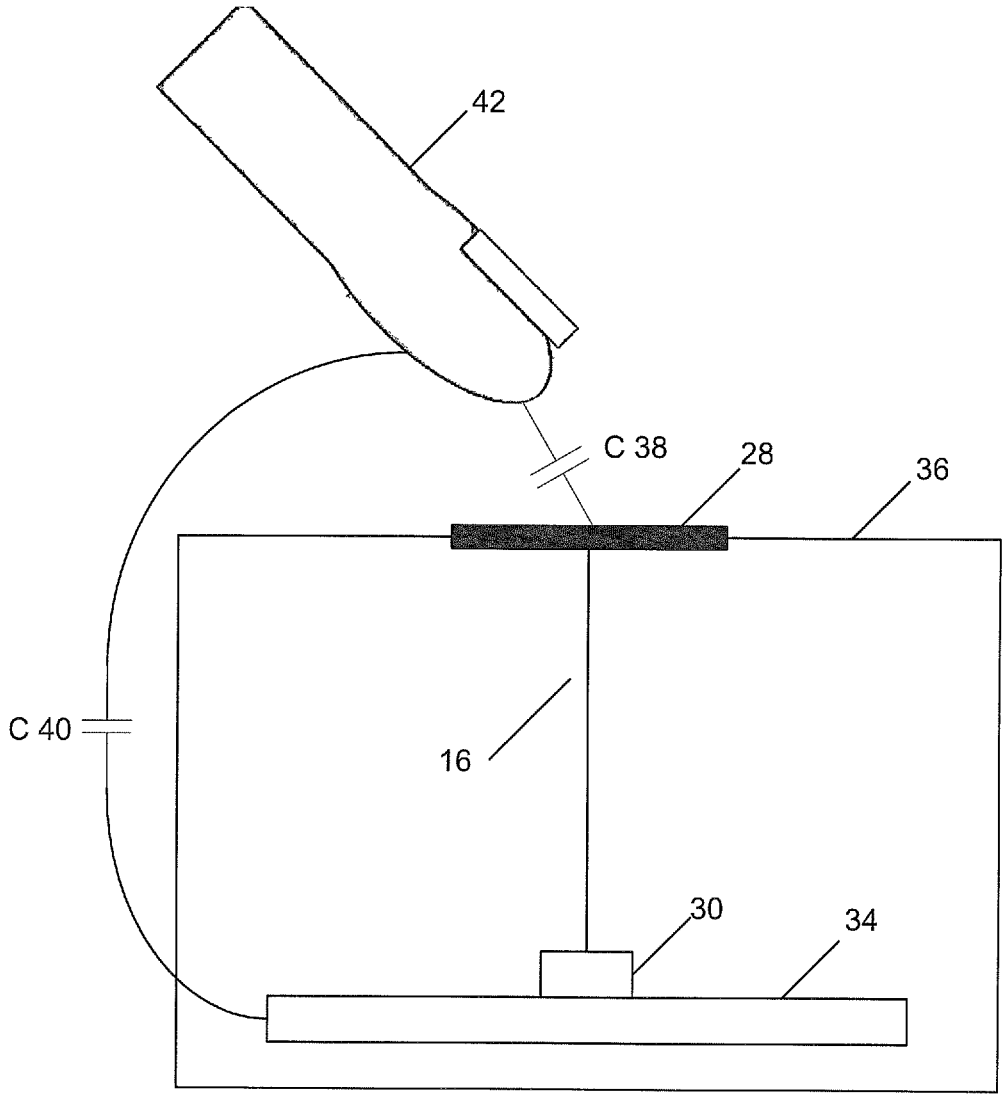
FIG. 2 illustrates a capacitive touch sensor in operation in one example.

FIG. 2 illustrates a capacitive touch sensor in operation in one example. FIG. 2 illustrates an example operation of the microphone system 100 where touch sensor 16 is a capacitive sensor, where the microphone system 100 has the capability to determine whether the microphone system 100 is being touch or about to be touched.

The microphone system 100 includes a housing 36 on which an electrode 28 formed from electrically conductive element is affixed. The electrode 28 is placed at the housing 36 at a location likely to be touched by a user finger 42 when the user handles the microphone. In one example, the electrode 28 is placed on a clip portion of the housing 36 which is utilized to clip the microphone system 100 to an article of user clothing. When the user finger 42 is brought in proximity to or in contact with the electrode 28, a sense capacitance C 38 is formed between the user skin surface and the electrode 28. The user's finger 42 can be considered the opposing plate of a capacitor to the electrode 28 with the capacitance C 38. A touch sensing system chip 30 is electrically connected to the electrode 28, and the touch sensing system chip 30 determines whether the electrode 28 is being touched by the user finger 42 based on the capacitance C 38 when the electrode 28 is touching the user finger 42 and when the electrode 28 is not.

It should be understood that the touch sensing system chip 30 can be located on a printed circuit board (PCB) 34, and there is parasitic capacitance between the electrode 28 and the PCB ground plane. This parasitic capacitance may be calibrated for in the measurement system. The capacitance between the user's finger 42 and the electrode 28 is indicated as capacitance C 38, and capacitance C 40 indicates the capacitance between the PCB ground plane and the user finger 42.

With the parasitic capacitance calibrated for, the total capacitance seen by the touch sensing system chip 30 is the series capacitance of the electrode to the finger, C 38, and the finger to the system, capacitance C 40. The capacitive connection of the user to the system ground, capacitance C 40, is usually a factor of 10 or more than the capacitance C 38 of the finger to the electrode, so that the capacitance C 38 dominates.

The user skin surface is a conductor, and where the user finger 42 is brought in proximity to the electrode 28 but not in contact with, the air gap there between results in a sense capacitance C 38 which increases as the user finger 42 is brought closer to the electrode 28 and the air gap decreases.

In operation, the significant measurable change in capacitance is between the user finger 42 and the electrode 28. Three states of operation may be monitored:

(1) The user finger 42 is very far from the electrode 28.

(2) The user finger 42 is in close proximity to the electrode 28, but not in direct contact.

(3) The user finger 42 directly contacts the electrode 28.

In a further example, the electrode 28 includes an overlaying insulating material. In this example, when the user finger 42 contacts the insulating material, the touch sensing system chip 30 measures the sense capacitance C 38 similar to case (2) above when the user finger 42 is brought in proximity to electrode 28.

Means which can be used for determining the capacitance of the electrode 28 are known and will therefore not be discussed in detail herein. For example the single-slope method or the dual slope method can be used. The single slope method involves driving an electrode with a DC current source and measuring the time for the capacitance to reach a reference level. In one example implementation, certain components shown in FIG. 2 are integrated with components at microphone system 100. For example, sensor chip 30 and PCB 34 may be integrated with controller 10 and a system PCB, respectively.

Figure 3:
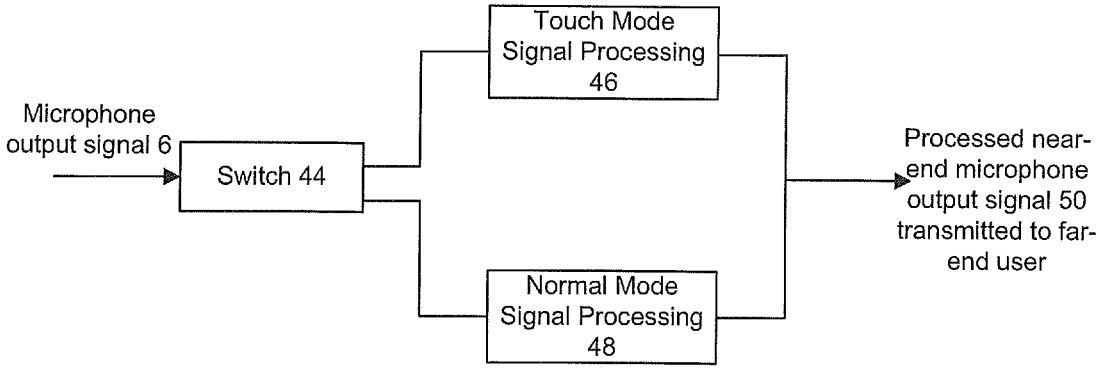
FIG. 3 illustrates signal processing of a microphone output signal based on touch state in one example.

FIG. 3 illustrates signal processing of a microphone output signal based on touch state in one example. As described above in reference to FIG. 2, microphone system 100 determines whether it is being touched or about to me touched (i.e., the user finger is in close proximity to the electrode 28) based on the output of touch sensor 16. In the example shown in FIG. 3, an electronic switch 44 is operated to route microphone output signal 6 to a touch mode signal processing block 46 responsive to a determination the touch sensor 16 is in proximity to or touching the user finger or a normal mode signal processing block 48 responsive to the determination the touch sensor 16 is not in proximity to or touching the user finger. Following either touch mode signal processing block 46 or normal mode signal processing block 48, a processed near-end microphone output signal 50 is transmitted to a far end-user, such as a call participant at a telephone remote from the user. In one example, normal mode signal processing includes noise reduction adapted for a microphone output signal from a microphone not being touched. Normal mode is usually optimized for the most natural sounding audio with full dynamic range, while meeting audio performance standards such as TIA-920, for example. In one example, touch mode signal processing block 46 includes attenuating, limiting, or compressing the microphone output signal for a duration of the touch state in which the user is touching or in proximity to the touch sensor 16. In further examples, touch mode signal processing block 46 may include any type of enhanced signal processing adapted to address noise artifacts resulting from a user touching the microphone system 100, whereby the enhanced signal processing is not performed during normal mode signal processing.

Both normal mode signal processing block 48 and touch mode signal processing block 46 may include signal processing techniques known in the art. These include, for example, noise reduction algorithms and echo control algorithms.

Figure 4:
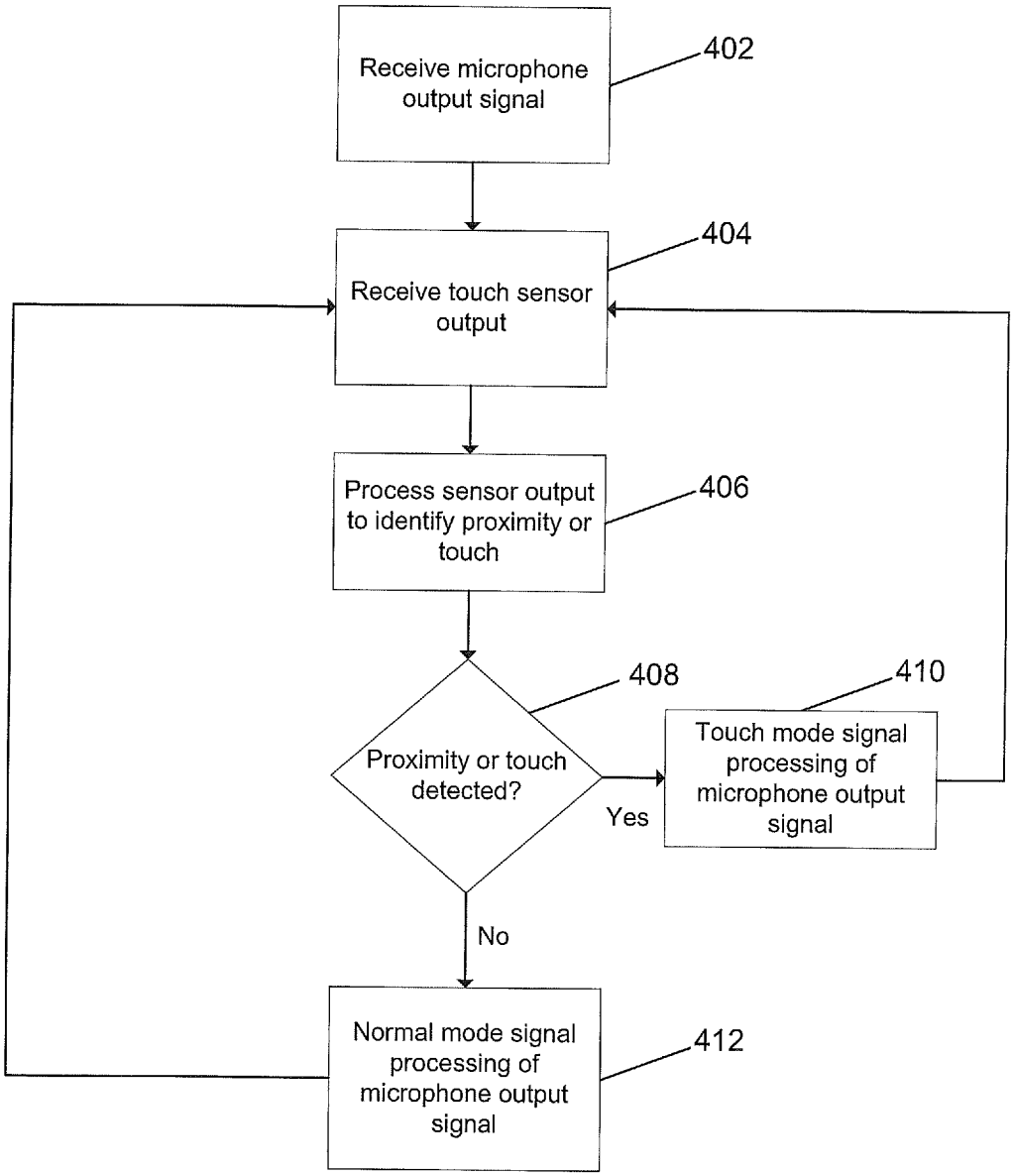
FIG. 4 is a flow diagram illustrating processing a microphone signal based on a touch sensor output in one example.

FIG. 4 is a flow diagram illustrating processing a microphone signal based on a touch sensor output in one example. At block 402, a microphone output signal is received. At block 404, a touch sensor output is received. At block 406, the touch sensor output is processed to identify proximity of a user or touch by the user. At decision block 408, it is determined whether user proximity or touch has been detected. If no at decision block 408, the process proceeds to block 412.

At block 412, the microphone output signal is processed using normal mode signal processing. Following block 412, the process returns to block 404. If yes at decision block 408, at block 410 the microphone output signal is processed using touch mode signal processing. Following block 410, the process returns to block 404.

Figure 5:
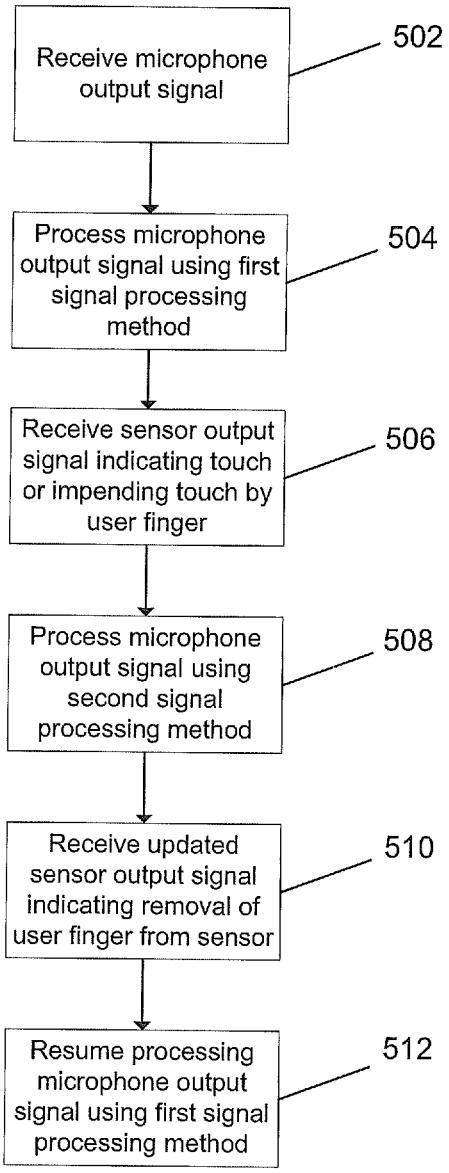
FIG. 5 is a flow diagram illustrating processing a microphone signal based on a touch sensor output in a further example.

FIG. 5 is a flow diagram illustrating processing a microphone signal based on a touch sensor output in a further example. At block 502, a microphone output signal is received. At block 504, the microphone output signal is processed using a first signal processing method. At block 506, a sensor output signal is received indicating touch or impending touch by a user finger at a sensor. At block 508, the microphone output signal is processed using a second signal processing method differing from the first signal processing method responsive to receiving the sensor output signal indicating touch or impending touch by a user at the sensor. For example, the second signal processing method may include attenuating the microphone signal or limiting the microphone signal. At block 510, an updated sensor output signal is received indicating removal of the user finger from the sensor. At block 512, processing of the microphone output signal using the first signal processing method is resumed.

While the exemplary embodiments of the present invention are described and illustrated herein, it will be appreciated that they are merely illustrative and that modifications can be made to these embodiments without departing from the spirit and scope of the invention. For example, the types of signal processing applied to address noise artifacts resulting from user handling of the microphone system may vary. Thus, the scope of the invention is intended to be defined only in terms of the following claims as may be amended, with each claim being expressly incorporated into this Description of Specific Embodiments as an embodiment of the invention.

What is claimed is:

1. A microphone system comprising:

a microphone element to output a microphone output signal;

a touch sensor disposed on or within proximity of an outward facing surface of a microphone system housing, the touch sensor arranged to detect a proximity or a contact with a user skin surface of a user finger;

a touch sensor circuit coupled to the touch sensor configured to receive signals from the touch sensor and determine whether the touch sensor is touching the user skin surface of the user finger; and a processor adapted to process the microphone output signal using a modified signal processing responsive to a determination the touch sensor is touching the user skin surface of the user finger for a duration of the determination the touch sensor is touching the user skin surface and adapted to return to a normal mode signal processing following a termination of the determination the touch sensor is touching the user skin surface.

2. The microphone system of claim 1, wherein the modified signal processing responsive to a determination the touch sensor is in proximity to or touching the user skin surface of the user finger comprises use of a signal attenuator, compressor, or limiter.

3. The microphone system of claim 1, wherein the touch sensor circuit is further configured to determine whether the touch sensor is in proximity to the user skin surface, and the processor is further adapted to process the microphone output signal using the modified signal processing responsive to a determination the touch sensor is in proximity to the user skin.

4. The microphone system of claim 1, wherein the touch sensor is a capacitive sensor.

5. The microphone system of claim 1, wherein the touch sensor is an infrared detector, pyroelectric sensor, a microswitch, an inductive proximity switch, or a skin resistance sensor.

6. The microphone system of claim 1, wherein the microphone system housing comprises a clip portion.

7. The microphone system of claim 1, wherein the microphone element is an electret condenser microphone.

8. The microphone system of claim 1, further comprising an accelerometer to output an accelerometer output signal, wherein the processor is adapted to process the microphone output signal responsive to the accelerometer output signal.

9. A method for processing a microphone signal comprising:

receiving a microphone signal output from a microphone element;

receiving a sensor output signal indicating a first condition where a user skin of a user finger is not in proximity to or in contact with a sensor or indicating a second condition where the user skin of the user finger is in proximity to or in contact with the sensor; and processing the microphone signal responsive to the sensor output signal using a touch mode processing for a duration of the second condition and then returning to a normal mode processing following a termination of the second condition.

10. The method of claim 9, wherein processing the microphone signal responsive to the sensor output signal indicating the second condition comprises attenuating the microphone signal for a duration of the second condition.

11. The method of claim 9, wherein processing the microphone signal responsive to the sensor output signal indicating the first condition comprises normal mode processing and processing the microphone signal responsive to the sensor output signal indicating the second condition comprises touch mode processing.

12. The method of claim 9, further comprising transmitting a processed microphone signal to a far-end listener.

13. A microphone system comprising:

a microphone to output a microphone output signal;

a sensor adapted to output a sensor signal indicating whether the sensor is in proximity to or touching a user finger; and a processor adapted to process the microphone output signal using a touch mode signal processing for a duration of a determination the sensor is in proximity to or touching the user finger and adapted to return to using a normal mode signal processing following a termination of the determination the sensor is in proximity to or touching the user finger.

14. The microphone system of claim 13, wherein the touch mode signal processing comprises attenuating, limiting, or compressing the microphone output signal.

15. The microphone system of claim 13, wherein the sensor is a capacitive sensor, infrared detector, or pyroelectric sensor.

16. The microphone system of claim 13, wherein the sensor is disposed on or within proximity to a microphone system housing.

17. The microphone system of claim 16, wherein the microphone system housing comprises a clip portion.

18. The microphone system of claim 13, wherein the microphone is an electret condenser microphone.

19. A method for processing a microphone signal comprising:

receiving a microphone signal output from a microphone element;

processing the microphone signal using a first signal processing method;

receiving a sensor output signal indicating a user finger in proximity to or in contact with a sensor;

processing the microphone signal using a second signal processing method responsive to receiving the sensor output signal indicating the user finger in proximity to or in contact with the sensor, the second signal processing method used for a duration that the sensor output signal indicates the user finger in proximity to or in contact with the sensor;

receiving an updated sensor output signal indicating removal of the user finger from contact with the sensor; and resuming processing the microphone signal using the first signal processing method.

20. The method of claim 19, wherein processing the microphone signal using a second signal processing method comprises attenuating the microphone signal or limiting the microphone signal.

21. The method of claim 19, further comprising transmitting a processed microphone signal to a far-end listener.

* * * * *